United States Patent [19]

Thomas, Jr.

[11] 4,437,278

[45] Mar. 20, 1984

[54] WALL PARTITION LOCKING SYSTEM

[76] Inventor: Donald K. Thomas, Jr., 1710 Laurel St., Pasadena, Calif. 91030

[21] Appl. No.: 350,821

[22] Filed: Feb. 22, 1982

[51] Int. Cl.[3] ..... B21B 31/08; B21C 1/04; B21C 1/12

[52] U.S. Cl. ..... 52/239; 52/282; 52/288

[58] Field of Search ..... 52/239, 288, 281, 36, 52/465, 731, 282, 285, 286, 588, 127.6, 284, 127.1, 127.5, 220, 287; 403/205, 383, 403, 231; 411/182, 409

[56] References Cited

U.S. PATENT DOCUMENTS

| | | | |
|---|---|---|---|
| 1,541,518 | 6/1925 | McCain | 411/409 |
| 2,730,209 | 1/1956 | Larson | 52/285 |
| 2,800,983 | 7/1957 | Toney | 52/282 |
| 2,963,131 | 12/1960 | Brockway | 52/239 |
| 3,013,642 | 12/1961 | Hammitt et al. | 52/220 |
| 3,195,698 | 7/1965 | Codrea | 52/731 |
| 3,508,593 | 4/1970 | Gill | 411/182 |
| 3,699,734 | 10/1972 | Craig et al. | 52/127.6 |
| 3,797,184 | 3/1974 | Thompson | 52/239 |
| 3,995,403 | 12/1976 | Nickell | 52/284 |
| 4,038,790 | 8/1977 | Paisley | 52/36 |
| 4,147,001 | 4/1979 | Oliver | 52/284 |

*Primary Examiner*—John E. Murtagh
*Assistant Examiner*—Andrew Joseph Rudy
*Attorney, Agent, or Firm*—Harlan P. Huebner

[57] ABSTRACT

A locking system for retaining a pair of modular wall partitions in locked relationship. The locking system includes a threaded insert means in the first partition end aligned with a bolt extending through the end of the second partition. As the bolt is threaded into the insert the respective ends of the partitions are drawn together to lock the same in a rigid connection one to the other.

7 Claims, 4 Drawing Figures

WALL PARTITION LOCKING SYSTEM

BACKGROUND OF THE INVENTION

Heretofore wall partitions of the modular type to surround a desk have been affixed directly to the desk to maintain the same in position.

Additionally, there are in use permanent types of office partitions that are built or assembled as a single unit. These partitions cannot be readily disassembled for moving purposes.

Further, where office partitions have been of the modular type and not secured to desks they have been fixed to the floor which can cause additional time of removal when they are to be disassembled.

SUMMARY OF THE INVENTION

This invention relates to a locking system for modular wall partitions wherein the end of one partition can be inserted within the end of another partition and means are used to affix the two sections together.

An object of the invention is to provide modular wall partitions which need not be affixed to a desk or the floor to maintain the same in position around a desk.

A further object of the invention is to provide office modular wall partitions whereby extruded end pieces of various partitions are formed of specific cross-sectional configuration whereby one end wall frictionally interfits within another.

A still further object of the invention is to provide a releasable locking system to maintain the ends of the partitions locked together.

Another object of the invention is to provide a cover plate means which can be inserted on one end piece of a partition to conceal the locking means.

A still further object of the invention is to provide modular wall partition locking means for modular wall partitions which are lightweight, of adequate strength and relatively inexpensive.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to accompanying drawing, which is for illustrative purposes.

DESCRIPTION OF THE PREFERRED EMBODIMENT

Figure 1:
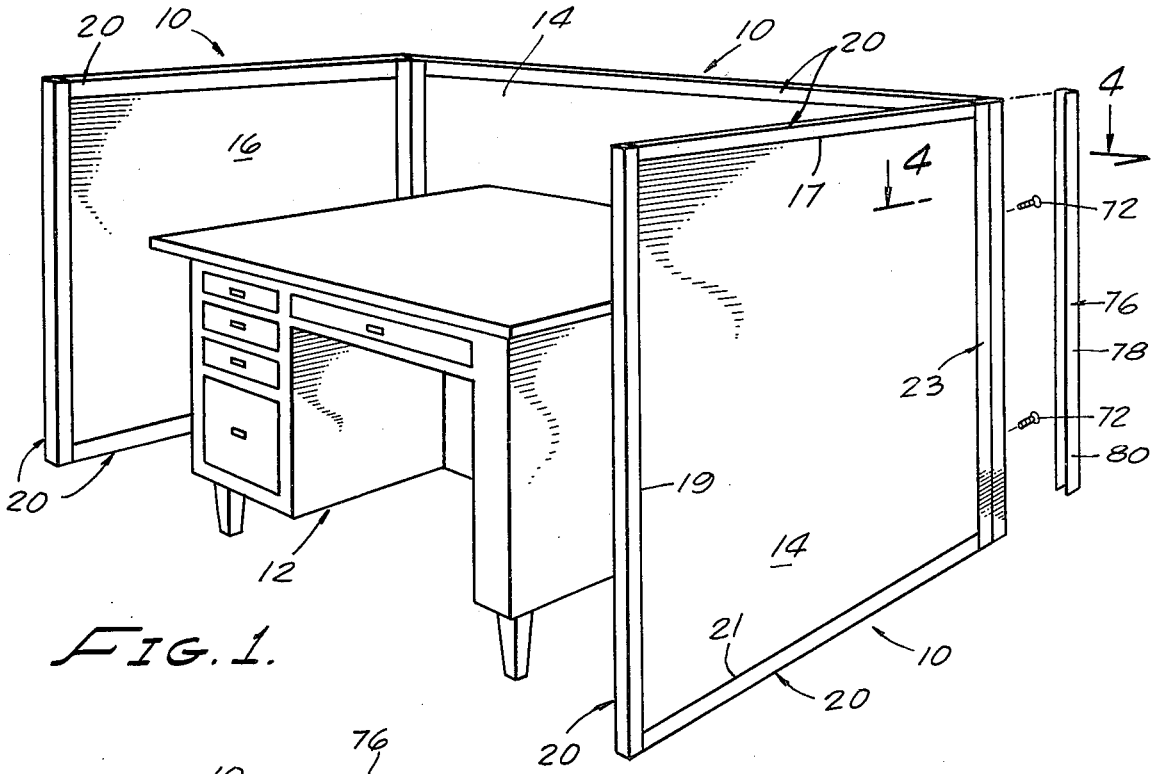
FIG. 1 is a perspective view of modular partitions including locking means of the present invention.
Figure 2:
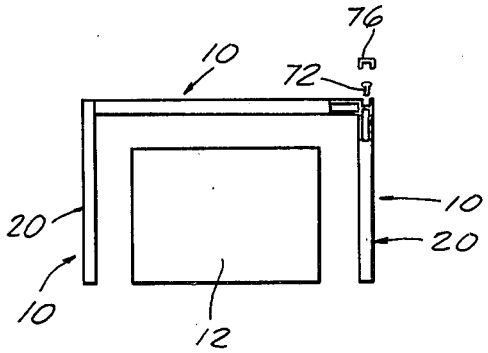
FIG. 2 is a top plan view of a desk partially surrounded by wall partitions of this invention.
Figure 3:
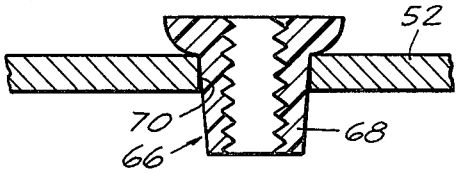
FIG. 3 is a cross-sectional view of a portion of the locking means of this invention.

Referring again to the drawings, there is shown in FIG. 1 an arrangement of wall partitions generally designated 10 to form a partial enclosure for a conventional desk 12. The primary purpose of the wall partitions 10 is to create a space which may be slightly larger than the top area of desk 12, as best seen in FIG. 2.

When there is no support for each partition 10, as by affixing the same to the edges of desk 12, the problem of securing each partition 10 one to the other becomes paramount. Particularly is this true when the partition 10 are to be modular where they can be easily disassembled and moved.

Accordingly, each partition 10 is generally conventional in nature with two opposed spaced panels 14 and 16, the panels typically being made of plastic laminations, hardboard or wood veneer with a decorative surface. Spacing the panels 14 and 16 is a honeycomb paper structure 18 which may be secured to the panels to create a partition 10.

In order to finish the top, end and bottom edges 17, 19 and 21 respectively of the partition 10 and complete each individual partition 10 there are generally U shaped frame members 20 which fit around the surrounding edges 17, 19 and 21, see FIG. 1. In the case of other edge perimeters 24 and 26 of the partition ends that interfit there are two frame members generally designated 23 and 25. Each frame member will extend to the respective ends of each edge and one may be joined to another in any conventional manner, such as a strap and screws holding to the other.

The frame members 23 and 25 are preferably formed of extruded aluminum, and cut to the necessary lengths to enclose the edge perimeters 24 and 26 of the panels 14 and 16.

Figure 4:
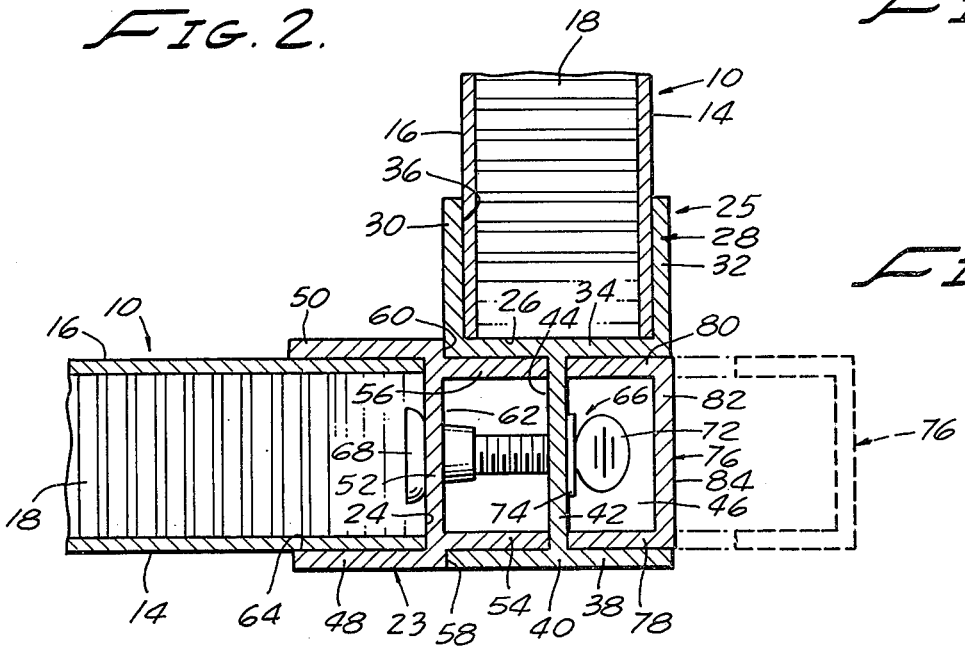
FIG. 4 is a cross-sectional view taken on line 4—4 of FIG. 1 showing details of this invention.

The frame member 25 includes in cross-section a generally U shaped portion 28 comprising opposed leg portions 30 and 32 and a base portion 34 extending between the legs 30 and 32 forming a channel 36, such as seen in FIG. 4. Extending from the base portion 34 and utilizing the portion 34 in cross-section is a generally H shaped portion 38. The base portion 34 forms one side of the H with an opposed, parallel side 40 united by a central cross member 42 to complete the H.

On each side of the cross member 42 inner and outer channels 44 and 46 are formed.

Turning now to the frame extrusion 23, in cross-section the extrusion generally resembles an H. There are a pair of opposed parallel leg portions 48 and 50 which are united by a cross member 52. Spaces inwardly of the leg portions 48 and 50 and extending from the cross member 52 in an opposite direction are leg portions 54 and 56. With the inwardly spaced leg portions 54 and 56 there is formed a shelf 58 and 60. On each side of the cross member 52 inner channel 62 and outer channel 64 are formed by the generally H shaped frame structure 23.

In construction the spaced panels 14 and 16 and the honeycomb structure 18 are inserted within the channels 36 and 64 respectively. They are each of such a thickness to be frictionally retained therein. Thus when the frame members 23 and 25 enclose the panels and honeycomb a completed partition 10 is created.

In order to assure the maintenance of the frames 23 and 25 together any form of bracket with appropriate screws may be used at the corners of the partition. These are not shown nor do they form a part of the present invention.

When it is desired to unite two partitions 10 together, that is one normal to the other such as seen in FIG. 1, locking means generally designed 66 are employed.

The locking means 66 includes threaded insert 68 which is positioned through an opening 70 cut in the cross member 52 of the frame member 23. As can be seen from FIG. 2 one end is enlarged so the insert 68 cannot be pulled through the hole or opening 70. The insert may be formed from plastic or metal.

A thumbscrew 72 is united to the threaded insert 68 by extending through an aligned hole or opening drilled in the cross member 42 of the other frame member 25. The thumbscrew 72 may include a collar or washer 74.

In operation, there are preferably two such locking means 66 for the connection of two partitions 10, best seen in FIG. 1. When the frame members 23 and 25 are frictionally interfitted as seen in FIG. 4, the thumbscrew 72 is inserted through channel 46 of the frame 25 and threadably engages the threaded insert 68. As the thumbscrew is turned it will draw the frame 23 toward frame 25 and lock the two together until it is desired to disassemble the partitions. In this way there is a sturdy, secure coupling of two partitions without the need of additional floor fastening.

To finish the joining of the frames 23 and 25 there is preferably provided a cap member 76 which is generally U shaped in cross-section. It includes a pair of spaced apart parallel legs 78 and 80 with a base 82 extending between them.

After the locking means are in place the cap member is inserted in the elongated channel 46 of frame 25 and will be frictionally maintained therein so that the bottom 84 of the base 82 will lie flush with leg portion 32 of frame member 25.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. A locking system for uniting two modular wall partitions normal to each other wherein each partition includes vertical end portions two spaced panels each respectively forming outer and inner wall surfaces, spacer means to maintain said panels in spaced relationship, said locking system comprising:

an elongated first frame member generally H shaped in cross-section having a coplaner wall partition receiving inner and outer channel formed by a pair of spaced parallel legs, said channels divided by a cross member extending between said legs and said legs of said outer channel extending around one of said end portions and engaging the outer and inner wall surfaces of a first wall partition;

an elongated second frame member which includes a generally U shaped portion in cross section forming a wall partition receiving channel for a second wall partition normal to said first wall partition, said U shaped portion formed by a pair of spaced parallel legs and including a base member, and said legs of said outer channel extending around one of said end portions and engaging the outer and inner wall surfaces of said second of said partitions, said second frame member also includes a generally T shaped portion in cross section projecting from said base member forming a coplaner inner and outer channel between said base member and the top of said T with the plane of said channels running normal to the plane of said wall receiving channel of U shaped portion;

a portion of said elongated first frame member adapted to frictionally interfit within a portion of second frame member; and removable locking means including a portion in said first elongated frame member and a portion in said second elongated frame member which when united will draw said frame member toward each other and maintain the first and second partitions in interlocked relationship one normal to the other.

2. A locking system as defined in claim 1 wherein said coplaner inner and outer channel of said second frame member formed by said T shaped portion includes a a common base leg cross member parallel with and spaced from said cross member of said first frame member; and said removable locking means extends through said common base leg member and said cross member of said first frame member.

3. A locking system as defined in claim 1 wherein there are at least two threaded inserts and thumbscrews in vertical alignment to interlock said wall partitions.

4. A locking system as defined in claim 1 wherein an elongated cap member of a length corresponding to the length of said first elongated frame member is provided to frictionally interfit within said outer channel of said second elongated frame member to conceal said removable locking means.

5. A locking system as defined in claim 4 wherein said cap member is removable and generally U shaped in cross section.

6. A locking system as defined in claim 2 wherein the width of said inner channel is less than the width of said outer channel of said first elongated frame member forming exterior recesses on each side of said parallel legs of said inner channel; and the interior width of said inner channel of said second elongated frame member corresponding to the exterior width of said inner channel of said first elongated frame member whereby when the two members are frictionally interfitted in said recesses the exterior leg of said outer channel and the top of the T are on a common plane.

7. A locking system as defined in claim 2 wherein said removable locking means includes:

a threaded thumbscrew with a thumb piece at one end thereof, wherein said thumbscrew passes through said cross member of said first frame member and said common base leg cross member of said second frame member with said thumb piece biased against said common base leg cross member; and a threaded insert within said outer channel of said first frame member bearing against said cross member and engageable with said thumbscrew, whereby when said thumbscrew is rotated said first and second frames will be drawn together in tight interlocked relationship.

* * * * *